US009452337B2

(12) United States Patent
Littman et al.

(10) Patent No.: US 9,452,337 B2
(45) **Date of Patent: *Sep. 27, 2016**

(54) SPORTS TRAINING TARGET AND KIT

(71) Applicants: Scott Littman, Morganville, NJ (US); Sean O'Brien, Freehold, NJ (US)

(72) Inventors: Scott Littman, Morganville, NJ (US); Sean O'Brien, Freehold, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/629,252

(22) Filed: Feb. 23, 2015

(65) Prior Publication Data

US 2015/0231474 A1 Aug. 20, 2015

Related U.S. Application Data

(63) Continuation of application No. 13/741,325, filed on Jan. 14, 2013, now Pat. No. 8,961,339.

(60) Provisional application No. 61/586,700, filed on Jan. 13, 2012.

(51) Int. Cl.
*A63B 69/00* (2006.01)
*A63B 63/00* (2006.01)

(52) U.S. Cl.
CPC ..... *A63B 69/0097* (2013.01); *A63B 63/004* (2013.01); *A63B 63/00* (2013.01); *A63B 69/002* (2013.01); *A63B 69/0002* (2013.01); *A63B 69/0026* (2013.01); *A63B 2063/001* (2013.01)

(58) Field of Classification Search
CPC ..... A63B 69/0097; A63B 69/0026; A63B 69/002; A63B 63/004; A63B 63/00; A63B 63/002; A63B 63/0025; A63B 71/022; A63B 2243/005; A63B 2243/0041; A63B 2243/0025
USPC ..... 473/422, 438, 446, 454, 470, 471, 477, 473/478, 434, 435
See application file for complete search history.

(56) References Cited

U.S. PATENT DOCUMENTS

| | | | |
|---|---|---|---|
| 331,756 | A | 12/1885 | Baker |
| D205,040 | S | 6/1966 | Bruns |
| 3,944,223 | A | 3/1976 | Bromwell |
| 4,921,257 | A | 5/1990 | Heller |
| 4,948,147 | A | 8/1990 | Pallanca |
| 5,000,461 | A | 3/1991 | Borazjani |
| 5,549,302 | A | 8/1996 | Lapsker et al. |
| D413,949 | S | 9/1999 | Oudemool et al. |
| 6,155,936 | A | 12/2000 | Dorr |
| 6,348,028 | B1 | 2/2002 | Cragg |
| 6,846,253 | B1 | 1/2005 | Szwalek |
| 7,074,140 | B1 | 7/2006 | McNary |
| 7,651,416 | B2 | 1/2010 | Farquhar |

(Continued)

*Primary Examiner* — Mitra Aryanpour
(74) *Attorney, Agent, or Firm* — Michael P. Kochka, Esq.

(57) ABSTRACT

A sports training target is provided. In exemplary embodiments, a sports training target may comprise a return net for substantially covering an opening defined by a frame, the return net having tension to withstand the impact of a sports projectile propelled from an originating location and having tension to allow the sports projectile to pass downward, exit a bottom portion of the return net, and return in the direction of the originating location; a target for substantially covering the return net, the target having an opening formed therein, the opening adapted to allow the sports projectile to pass behind the target to the return net, the target adapted to withstand the impact of a sports projectile, the target positioned in front of the return net, whereby a passage is formed between the target and the return net; and an attachment member adapted to attach the sports training target to the frame.

20 Claims, 4 Drawing Sheets

(56) References Cited

U.S. PATENT DOCUMENTS

| | | | | |
|---|---|---|---|---|
| 8,079,923 | B2 | 12/2011 | Siefker | |
| 8,246,494 | B2 | 8/2012 | Stephenson | |
| 8,961,339 | B2 * | 2/2015 | Littman | A63B 69/0097 473/422 |
| 2002/0151387 | A1 | 10/2002 | Henson | |
| 2013/0184103 | A1 | 7/2013 | Littman et al. | |

* cited by examiner

SPORTS TRAINING TARGET AND KIT

CROSS-REFERENCE TO RELATED APPLICATIONS

This application is a continuation of U.S. patent application Ser. No. 13/741,325, filed Jan. 14, 2013, and tilted "Sports Training Target and Methods Thereof", which claims priority to U.S. Provisional Patent Application Ser. No. 61/586,700, filed Jan. 13, 2012, and titled "Sports Training Target and Methods Thereof," the disclosures of which are incorporated by reference herein in its entirety as if fully set forth herein.

BACKGROUND OF THE INVENTION

1. Field of the Invention

Embodiments of the present invention generally relate to a sports training target and methods thereof. More specifically, embodiments of the present invention relate to a sports training target having return capabilities making recovery of a successful shot less burdensome during practice.

2. Description of the Related Art

The sport of lacrosse is played with a solid rubber ball and a long handled stick having a netting at one end. A lacrosse player may use the stick to carry the ball and attempt to score a goal. Goals are scored by successfully propelling the ball into a goal net. To prevent players on opposing teams from scoring, goal nets are typically defended by a player referred to as the goalie. Goalies may attempt to prevent opposing players from scoring a goal by positioning their bodies and equipment in front of the goal at angles that minimize scoring chances. Because the goal net opening is larger than the physical size of the goalie and his or her equipment, even when a goalie is optimally positioned in front of the goal, openings still exist. A shooting player may be able to propel or "shoot" the ball into one of these openings and advance the ball past the goalie and into the goal net. Shooting the ball into one of these relatively small openings requires an accurate shot. An accurate shot is a skill that may be acquired by practice.

Practice nets and practice aids exist that are adapted to attempt to improve a players shooting accuracy. These practice nets and aids allow the player to shoot the ball into the net and may simulate the typical positioning of a goalie. After the player successfully shoots the ball into nets fitted with practice aids, however, the player must manually remove the ball from the net by walking up to the net and retrieving the ball. None of these practice aids return the ball to the shooter, and much of practice time must be spent retrieving balls from the net. Similarly, other sports also utilize practice nets and practice aids that do not return the shooting object to the shooter. For example, existing practice aids for shooting accuracy for soccer or hockey do not return the ball or puck, respectively, to the user. Thus, a need exists for a sports training target having return capabilities making recovery of a successful shot less burdensome during practice.

SUMMARY

Embodiments of the present invention generally relate to a sports training target and methods thereof. In exemplary embodiments, a sports training target may comprise: a return net for substantially covering an opening defined by a frame, the return net adapted to withstand the impact of a sports projectile propelled from an originating location and allow the sports projectile to pass downward along the return net, exit a bottom portion of the return net, and return in the direction of the originating location; a target for substantially covering the return net, the target having an opening formed therein, the opening adapted to allow the sports projectile to pass behind the target to the return net, the target adapted to withstand the impact of a sports projectile; and an attachment means adapted to attach the sports training target to the frame.

In exemplary embodiments, a sports training target kit may comprise: a frame comprising a top bar and a pair of side posts; a return net for substantially covering an opening defined by the frame, the return net adapted to withstand the impact of a sports projectile propelled from an originating location and allow the sports projectile to pass downward along the return net, exit a bottom portion of the return net, and return in the direction of the originating location; a target for substantially covering the return net, the target having an opening formed therein, the opening adapted to allow the sports projectile to pass behind the target to the return net, the target adapted to withstand the impact of a sports projectile; and an attachment means adapted to attach the sports training target to the frame.

BRIEF DESCRIPTION OF THE DRAWINGS

So the manner in which the above recited features of the present invention can be understood in detail, a more particular description of embodiments of the present invention, briefly summarized above, may be had by reference to embodiments, which are illustrated in the appended drawings. It is to be noted, however, the appended drawings illustrate only typical embodiments of embodiments encompassed within the scope of the present invention, and, therefore, are not to be considered limiting, for the present invention may admit to other equally effective embodiments, wherein.

Figure 1:
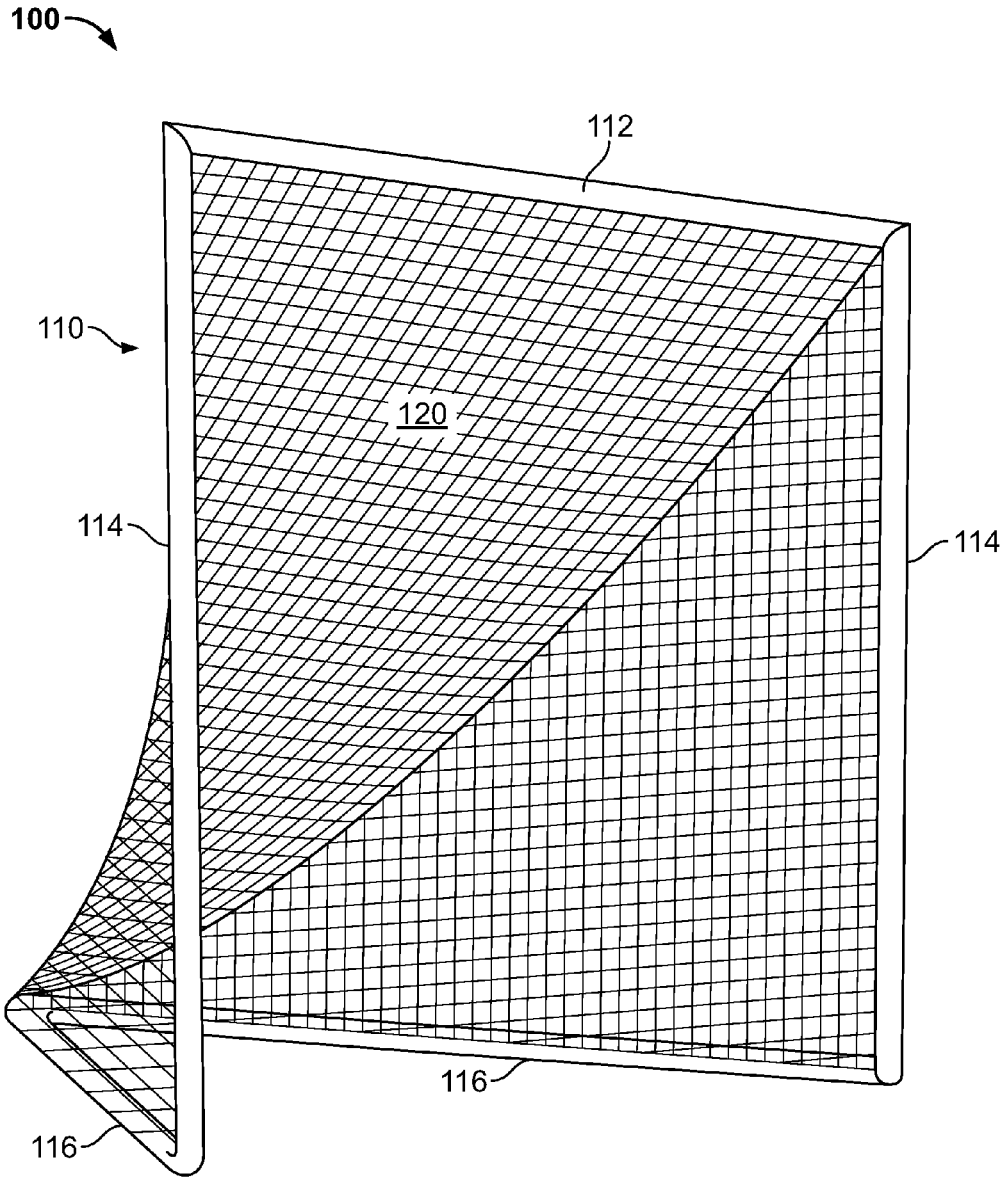
FIG. 1 depicts a perspective view of a standard lacrosse goal in accordance with one embodiment of the present invention.

The headings used herein are for organizational purposes only and are not meant to be used to limit the scope of the description or the claims. As used throughout this application, the word may is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

Embodiments of the present invention generally relate to a sports training target and methods thereof. More specifically, embodiments of the present invention relate to a sports training target having return capabilities making recovery of a successful shot less burdensome during practice.

FIG. 1 depicts a perspective view of a standard lacrosse goal in accordance with one embodiment of the present invention. A standard lacrosse goal 100 generally comprises a frame 110 and a net 120. The frame 110 often comprises at least a top bar 112 (often called a "cross bar"), a pair of side posts 114, and a pair of base bars 116 (collectively, often called a "flat-bottom base"). As shown in the Figure, a lacrosse goal generally comprises a substantially square opening on its front surface (i.e., the opening), through which a player could score, and a substantially triangular base. Such design generally makes lacrosse goals quite easy to recognize to those of ordinary skill in the art.

In many embodiments, the lacrosse goal 100 comprises any type of common or typical lacrosse goals. In one embodiment, the lacrosse goal 100 comprises a regulation high school, NCAA, professional, or similar type of known lacrosse goal 100. In another example, the lacrosse goal 100 may comprise a collapsible frame, such as a portable lacrosse goal. The lacrosse goal 100 may generally be made of an extruded metal, and in alternative embodiments, the lacrosse goal 100 may be a practice goal, made from any type of material suitable for embodiments of the present invention.

Figure 2:
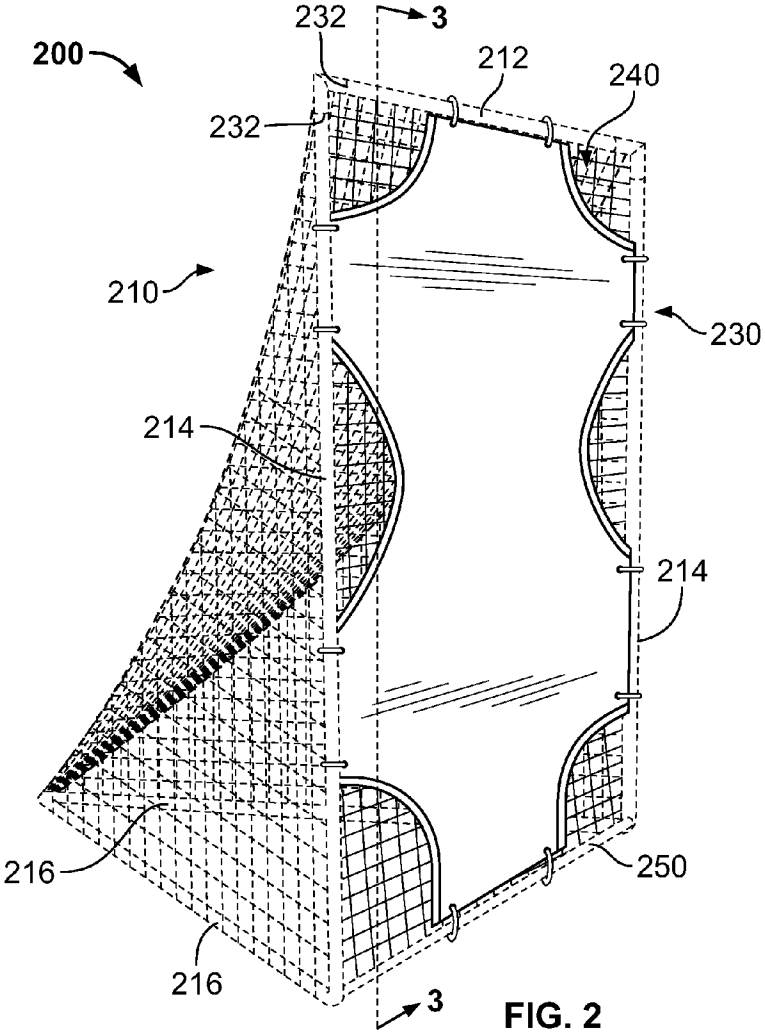
FIG. 2 depicts a perspective view of a lacrosse goal having a sports training target thereon, in accordance with one embodiment of the present invention.

FIG. 2 depicts a perspective view of a lacrosse goal having a sports training target thereon, in accordance with one embodiment of the present invention. As shown in the Figure, the lacrosse goal 200 is similar to that shown in FIG. 1, having a frame 210 and a net (not shown for simplicity). Similarly, the frame 210 comprises the top bar 212, the side posts 214 and the base 216. However, the lacrosse goal 200 also comprises a sports training target thereon.

The sports training target generally comprises a target 230, having one or more target positions (i.e., gaps or openings for which a player may aim), and a return net 240. In many embodiments, the target 230 and the return net 240 are affixed together, through stitching, adhesive, or the like. However, in certain embodiments the two components may be provided separately. The sports training target often comprises the target 230 positioned over the return net 240, such that the target 230 faces a player who may be practicing on the lacrosse goal 200. In some embodiments, the return net may be adapted to substantially cover an opening formed by the frame 210.

The sports training target generally comprises a means for attaching the sports training target to the frame 210. In many embodiments, the means for attaching comprises a plurality of straps 232, having hook and loop fasteners, plastic and/or elastic ties, snaps, buckles, buttons, or similar type of mechanical fastener capable of holding the target to the frame. In some embodiments the means for attaching, attachment means, or attachment member, may comprise an elastic tie, a plastic tie, and pair of straps, the pair of straps having at least one of a snap set, a buckle set, a hook and loop fastener set, and a button set disposed thereon. As shown, the means for attaching the target to the frame may positioned around most of the target for affixing to the top bar 212 and the side posts 214.

The target 230 may comprise any type of material suitable for embodiments of the present invention. For example, the target may comprise any type of polymer, leather, or any similar natural or synthetic material capable of withstanding the impact of a lacrosse ball and/or other sports projectile being shot at it at high velocity. The net 240 may similarly comprise any type of material suitable for embodiments of the present invention. In many embodiments, the net comprises the same or similar density, composition and strength as a typical lacrosse net known to those of ordinary skill in the art.

Generally, the net 240 is positioned behind the target 230 with sufficient tension to allow a ball and/or other sports projectile propelled from an originating location to pass through a target position in the target 230, pass downward along the net 240, pass out/exit along a bottom portion of the net 240, and return in the general direction of the originating location. In embodiments where the net 240 and target 230 are preattached, such tension may be easily set by the manufacturer. However, in other embodiments, where the net 240 and target 230 are separate articles, the player may have to set such tension by adjusting the means for attaching the target to the frame (e.g., by adjusting the straps—one set of straps for the target, another set of straps for the return net).

Optionally, in many embodiments, the sports training target further comprises a return bar 250 to assist in the return of the ball and/or other sports projectile after a successful practice shot is taken. In such embodiments, the return bar 250 comprises a weighted bar, or similarly functioning structure, positioned at or near the bottom of the return net 230. The return bar 250 may be attached to the return net 240, or in some embodiments, be affixed thereto in a pouch, pocket, via connection means (e.g., straps or similar connective structure), or the like.

In some embodiments the return bar 250 comprises a metal bar, a metal rod, or wooden dowel capable of ensuring proper tension in the return net 240 and/or providing a physical device, which when passed over and/or contacted by a ball and/or other sports projectile passing down along the return net (as described herein) forces the ball and/or other sports projectile to return outward towards the player, away from the net in the general direction of the originating location. In some embodiments, the return bar 250 comprises several smaller bars, a telescoping bar, or a collapsible bar.

Figure 3:
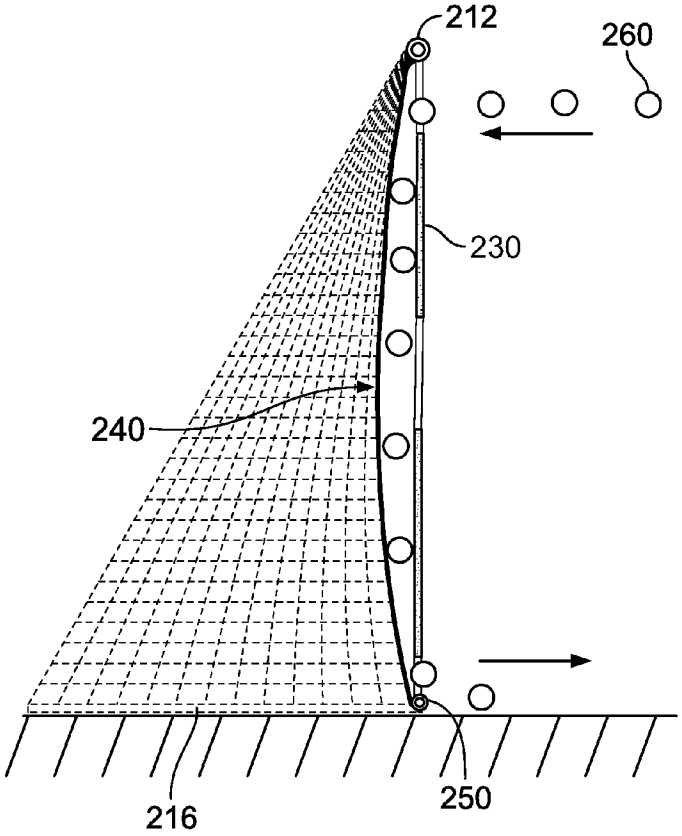
FIG. 3 depicts a side cross-sectional view of a lacrosse goal having a sports training target thereon, showing a ball passing therethrough, in accordance with one exemplary embodiment of the present invention.

FIG. 3 depicts a side cross-sectional view along the line 3-3 of FIG. 2, of a lacrosse goal having a sports training target thereon, showing a ball passing therethrough, in accordance with one exemplary embodiment of the present invention. Although a ball is depicted in FIG. 3, other sports projectiles may be used in accordance with the present disclosure. For example, a hockey puck or a soccer ball may also be used. Further, although a lacrosse goal 200 is depicted in the Figures, other types of goals may be used in accordance with embodiments of the present disclosure. For example, a hockey goal or a soccer goal may be used. To clarify the basic structure and operation of the lacrosse goal 200 of FIG. 2, FIG. 3 provides a simplified schematic of how a sports training target may work in one embodiment of the present invention.

In the Figure, a single lacrosse ball 260 is shown in various locations as the lacrosse ball 260 passes through the sports training target. In the embodiment depicted, the lacrosse ball 260 may be thrown towards the target 230 and pass through a target position. Once it passes through the target position, the lacrosse ball 260 hits the return net 240. Due to the tension in the net, the lacrosse ball 260 often immediately begins to roll downward along the net. Once the lacrosse ball 260 gets to the bottom of the return net 240, the lacrosse ball 260 may encounter the optional return bar 250. By hitting the return bar 250, the lacrosse ball 260 is forced forward, such that it rolls back towards where the player initially shot the lacrosse ball 260.

As the return net 240 generally covers the entirety of the back of the target 230, regardless of which target position is hit, the return net 240 will likely force the ball downward and out from the bottom of the return net. In alternative embodiments of the present invention, rather than a return bar 250, the return net 240 may be connected to some type of storage assembly (for storing a plurality of lacrosse balls), a long channel (to feed the lacrosse balls back to a particular location, or the like.

Figure 4:
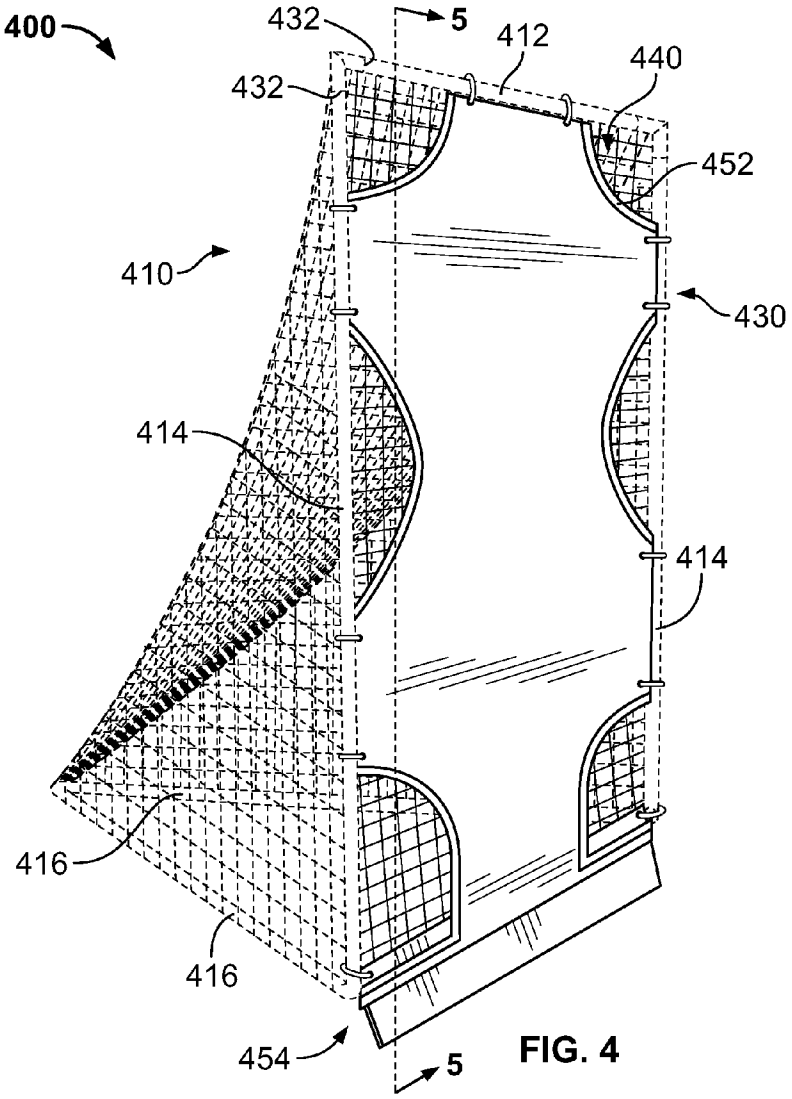
FIG. 4 depicts a perspective view of a lacrosse goal having a sports training target thereon, in accordance with one embodiment of the present invention.

FIG. 4 depicts a perspective view of a lacrosse goal having a sports training target thereon, in accordance with one embodiment of the present invention. As shown in the Figure, the lacrosse goal 400 is similar to that shown in FIGS. 1 and 2, having a frame 410 and a net (not shown for simplicity). Similarly, the frame 410 comprises the top bar 412, the side posts 414 and the base 416. The lacrosse goal 400 also comprises a sports training target thereon, similar to that shown in FIG. 2. The sports training target generally comprises a target 430, having one or more target positions (i.e., gaps or openings for which a player may aim), and a return net 440. The sports training target generally comprises a means for attaching the sports training target to the frame 410. In many embodiments, the means for attaching comprises a plurality of straps 432, having hook and loop fasteners, plastic and/or elastic ties, snaps, buckles, or similar type of mechanical fastener capable of holding the target to the frame.

In addition, in many embodiments, the sports training target further comprises a return flap 454 to assist in the return of the ball after a successful practice shot is taken. In such embodiments, the return flap 454 comprises a weighted piece of fabric, textile, or similarly functioning material, positioned at or near a bottom portion of the return net 430. The return flap 454 may also be non-weighted. The return flap 454 may also comprise a substantially rigid material, such as metal or plastic. The return flap 454 may be attached to the return net 440, or in some embodiments, may be detachably attached. In some embodiments the return flap 454 is made of the same material as the target 430. The return flap 454 may be adapted to direct a ball and/or other sports projectile away from the return net and in the direction of the originating location, i.e., the player, when the return flap 454 is passed over and/or contacted with the ball and/or other sports projectile. In some embodiments, the sports target may also comprise one or more reinforcing members 452 for adding supports to the edges of the target positions/openings. By way of example, the reinforcing members 452 may comprise a piece or pieces of reinforcing fabric, tape, plastic, or the like, adapted to reinforce the edges of the target positions/openings and substantially prevent and/or reduce damage to the edges, such as tearing, fraying, or the like.

Figure 5:
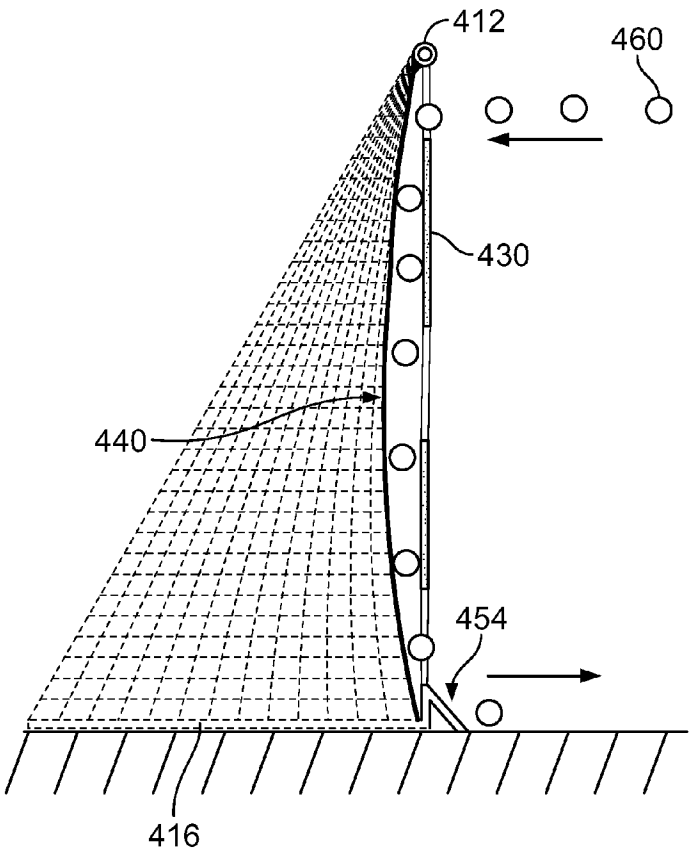
FIG. 5 depicts a side cross-sectional view of a lacrosse goal having a sports training target thereon, showing a ball passing therethrough, in accordance with one exemplary embodiment of the present invention.

FIG. 5 depicts a side cross-sectional view along the line 5-5 of FIG. 4, of a lacrosse goal having a sports training target thereon, showing a ball passing therethrough, in accordance with one exemplary embodiment of the present invention. To clarify the basic structure and operation of the lacrosse goal 400 of FIG. 4, FIG. 5 provides a simplified schematic of how a sports training target may work in one embodiment of the present invention.

In FIG. 5, a single lacrosse ball 460 is shown in various locations as the lacrosse ball 460 passes through the sports training target. In the embodiment depicted, the lacrosse ball 460 may be thrown towards the target 430 and pass through a target position. Once it passes through the target position, the lacrosse ball 460 hits the return net 440. Due to the tension in the net, the lacrosse ball 460 often immediately begins to roll downward along the net. Once the lacrosse ball 460 gets to the bottom of the return net 440, the lacrosse ball 460 may encounter the optional return flap 454. By hitting the return flap 454, the lacrosse ball 460 is forced forward, such that it rolls back towards where the player initially shot the lacrosse ball 460.

Figure 6A:
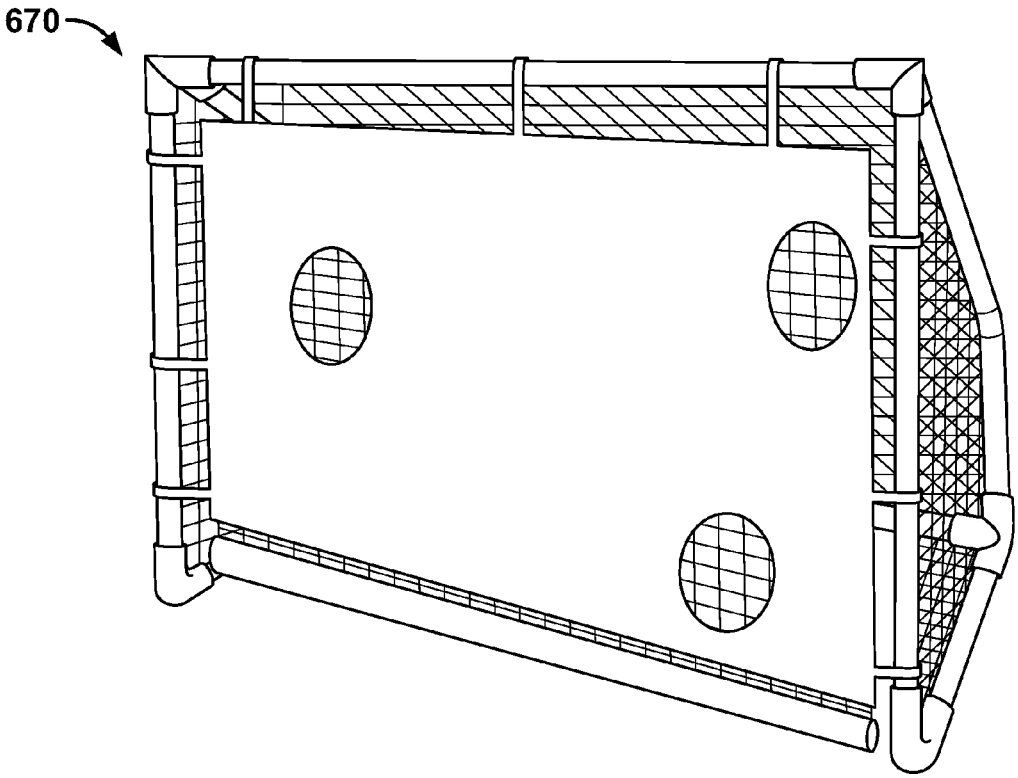
FIGS. 6A and 6B depict a soccer goal and a hockey goal, respectively, having a sports training target thereon, in accordance with alternative embodiments of the present invention.
Figure 6B:
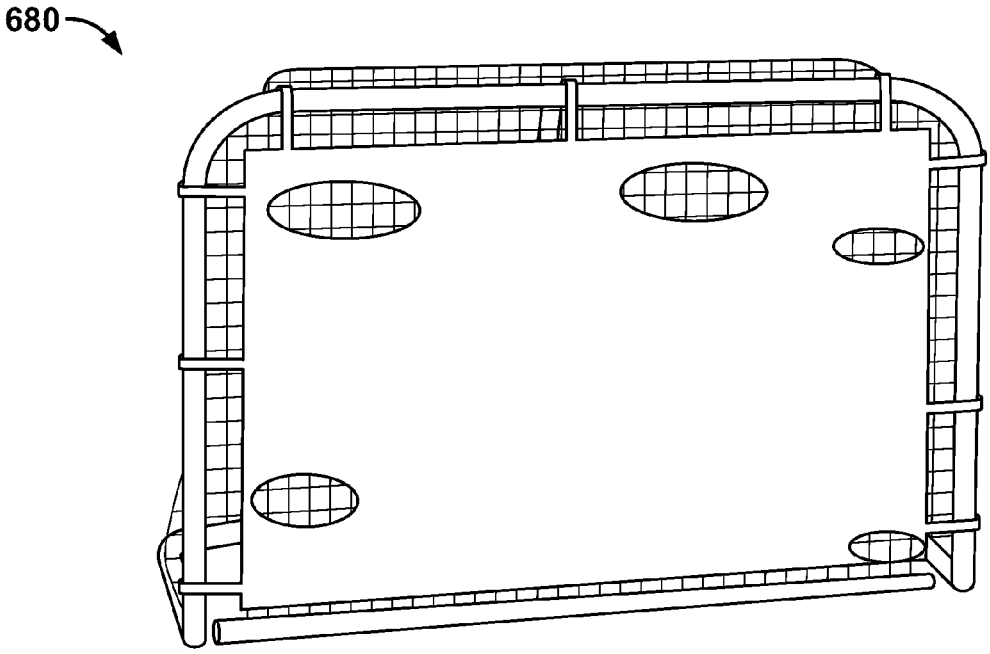

FIGS. 6A and 6B depict a soccer goal and a hockey goal, respectively, having a sports training target thereon, in accordance with alternative embodiments of the present invention. While many of the embodiments described herein are directed to lacrosse goals, embodiments of the present invention may be provided on various other types of sports goals, as would be recognizable by one of ordinary skill in the art. For example, a soccer goal 670 or a hockey goal 680 may easily be adapted to receive a sports training target thereon. Any other type of sport goal may also be adapted to receive an embodiment of the sports training target in further embodiments of the present invention.

In many embodiments, the sports training target is provided as a kit, separate from any type of goal. As such, embodiments of the present invention may be independent of any particular or specific goal, but rather, comprise at least a target, a return net, a means for attaching the sports training target to a frame, and optionally, a return bar. In some embodiments, the sports training target may be provided as a kit with a frame. When provided as a kit with a frame, the sports training target may be free-standing and may not require a goal net to be used.

While the foregoing is directed to exemplary embodiments of the present invention, other and further embodiments of the invention may be devised without departing from the basic scope thereof, and should be considered part of this disclosure, as if described fully herein.

What is claimed is:

1. A sports training target comprising:

a return net for substantially covering an opening defined by a frame, the return net having tension to withstand the impact of a sports projectile propelled from an originating location and having tension to allow the sports projectile to pass downward, exit a bottom portion of the return net, and return in the direction of the originating location;

a target for substantially covering the return net, the target having an opening formed therein, the opening adapted to allow the sports projectile to pass behind the target to the return net, the target adapted to withstand the impact of a sports projectile, the target positioned in front of the return net, whereby a passage is formed between the target and the return net; and an attachment member adapted to attach the sports training target to the frame.

2. The sports training target of claim 1, further comprising a return bar for directing the sports projectile away from the return net and in the direction of the originating location when the sports projectile contacts the return bar, the return bar disposed at the bottom portion of the return net.

3. The sports training target of claim 2, wherein the return bar comprises at least one of a metal bar, a metal rod, and a wooden dowel.

4. The sports training target of claim 1, further comprising a return flap for directing the sports projectile away from the return net and in the direction of the originating location when the sports projectile contacts the return flap, the return flap disposed at the bottom portion of the return net.

5. The sports training target of claim 4, wherein the return flap is detachably attachable to the target.

6. The sports training target of claim 1, wherein the attachment member comprises at least one of an elastic tie, a plastic tie, and pair of straps, the pair of straps having at least one of a snap set, a buckle set, a hook and loop fastener set, and a button set disposed thereon.

7. The sports training target of claim 1, wherein the sports projectile comprises at least one of a lacrosse ball, a hockey puck, and a soccer ball.

8. The sports training target of claim 1, wherein the target and the return net are attached to each together.

9. The sports training target of claim 8, wherein the target and the return net are attached to each other with at least one of stitching and an adhesive.

10. The sports training target of claim 1, wherein the attachment member is adapted to adjust a tension level of the return net.

11. A sports training target kit comprising:

a frame comprising a top bar and a pair of side posts;

a return net for substantially covering an opening defined by a frame, the return net having tension to withstand the impact of a sports projectile propelled from an originating location and having tension to allow the sports projectile to pass downward, exit a bottom portion of the return net, and return in the direction of the originating location;

a target for substantially covering the return net, the target having an opening formed therein, the opening adapted to allow the sports projectile to pass behind the target to the return net, the target adapted to withstand the impact of a sports projectile, the target positioned in front of the return net, whereby a passage is formed between the target and the return net; and an attachment member adapted to attach the sports training target to the frame.

12. The sports training target of claim 11, further comprising a return bar for directing the sports projectile away from the return net and in the direction of the originating location when the sports projectile contacts the return bar, the return bar disposed at the bottom portion of the return net.

13. The sports training target of claim 12, wherein the return bar comprises at least one of a metal bar, a metal rod, and a wooden dowel.

14. The sports training target of claim 11, further comprising a return flap for directing the sports projectile away from the return net and in the direction of the originating location when the sports projectile contacts the return flap, the return flap disposed at the bottom portion of the return net.

15. The sports training target of claim 14, wherein the return flap is detachably attachable to the target.

16. The sports training target of claim 11, wherein the attachment member comprises at least one of an elastic tie, a plastic tie, and pair of straps, the pair of straps having at least one of a snap set, a buckle set, a hook and loop fastener set, and a button set disposed thereon.

17. The sports training target of claim 11, wherein the sports projectile comprises at least one of a lacrosse ball, a hockey puck, and a soccer ball.

18. The sports training target of claim 11, wherein the target and the return net are attached to each together.

19. The sports training target of claim 18, wherein the target and the return net are attached to each other with at least one of stitching and an adhesive.

20. The sports training target of claim 11, wherein the attachment member is adapted to adjust a tension level of the return net.

* * * * *